US005601476A

United States Patent [19]

Maier et al.

[11] Patent Number: 5,601,476

[45] Date of Patent: Feb. 11, 1997

[54] METHOD FOR PRECISION-GRINDING A BEZEL AT THE INLET BORE A WORKPIECE

[75] Inventors: Rainer Maier, Nürtingen, Germany; Rudolf Koenigswieser, Steyr, Austria

[73] Assignees: Kadia-Maschinenbau Kopp GmbH & Co., Nurtingen; Robert Bosch GmbH, Stuttgart, both of Germany

[21] Appl. No.: 357,123

[22] Filed: Dec. 15, 1994

[30] Foreign Application Priority Data

Dec. 15, 1993 [DE] Germany ..... 43 42 681.6

[51] Int. Cl.[6] ..... B24B 1/00

[52] U.S. Cl. ..... 451/51; 451/57; 451/61; 29/888.075

[58] Field of Search ..... 29/888.075; 451/27, 451/51, 57, 61

[56] References Cited

U.S. PATENT DOCUMENTS

| | | | |
|---|---|---|---|
| 2,363,384 | 11/1944 | Beverlin | 451/51 |
| 2,787,866 | 4/1957 | Gross | 451/27 X |
| 2,978,846 | 4/1961 | Barron | 51/206 |
| 3,774,349 | 11/1973 | Uhtenwoldt et al. | 451/27 X |
| 4,147,462 | 4/1979 | Appleby et al. | 408/80 |
| 4,896,638 | 1/1990 | Shepley | 123/188 |
| 5,022,195 | 6/1991 | Cattelain et al. | 451/61 X |
| 5,133,628 | 7/1992 | Negus | 451/358 X |
| 5,269,103 | 12/1993 | Nagel et al. | 451/27 X |
| 5,305,556 | 4/1994 | Kopp et al. | 451/27 X |

FOREIGN PATENT DOCUMENTS

| | | | |
|---|---|---|---|
| 1052262 | 8/1959 | Germany . | |
| 150713 | 5/1983 | Germany . | |
| 234463 | 10/1991 | Japan | 451/61 |

*Primary Examiner*—Timothy V. Eley
*Attorney, Agent, or Firm*—Jones, Tullar & Cooper, P.C.

[57] ABSTRACT

A method for precision-grinding a bezel at the inlet of a bore of a workpiece, comprising the following steps:

a. generating a bezel at the inlet of the bore of the workpiece by grinding the workpiece at the inlet of the bore with a first grinding tool into a first shape defining an angle correspondingly slightly greater than a desired nominal angle;

b. honing the bore to generate a honed bore; and c. again grinding the bezel to its nominal shape by means of a second grinding tool, while simultaneously guiding the second grinding tool in the honed bore by means of a pilot.

5 Claims, 2 Drawing Sheets

METHOD FOR PRECISION-GRINDING A BEZEL AT THE INLET BORE A WORKPIECE

FIELD OF THE INVENTION

The present invention relates to a method for precision-grinding a bezel at the inlet of a bore of a workpiece, and to a grinding tool.

BACKGROUND OF THE INVENTION

Bores with sealed seating created by precision-grinding and formed by a bezel are found in fuel injection pumps for internal combustion machines, for example. A tappet is movably disposed in the bores and conveys the desired amounts of fuel. To be able to guide the tappet sealingly in the bore, the surface of the bore is honed. When a defined pressure has been reached, the conveyed amount of fuel is delivered via a valve, whose sealed seating is formed by the bezel at the inlet of the bore, and on which a so- called sealing needle is seated as the valve element.

Precision processing of the bore is provided by honing and precision processing of the bezel by precision-grinding. As a rule, the bezel is first made by means of a grinding tool and is subsequently precision-ground by means of a tool. In the process, the tool is guided in a cylindrical guide which is a part of the tool holding fixture. The disadvantage in this case is that it is not possible to remove the offset of the axis of the tool guide relative to the bore in the workpiece, in fact it is possibly even increased.

Internal grinding of valve seats by means of a grinding tool is known from German Published, Examined Patent Application DE-AS 10 52 262. The grinding tool is rotatably seated on a guide rod which is received in a bushing which, in turn, is inserted into a guide bore. The guide rod does not turn during processing. Accordingly, the grinding tool rotatably seated on the guide rod can be displaced in the vertical direction with respect to the guide rod. Many sources of errors regarding the concentricity of the bore and the bezel result from the seating of the guide rod in a bushing, the seating of the bushing in a second bushing and the vertically displaceable guidance of this second bushing with respect to a cylindrical body which bears the grinding disk.

Furthermore, in connection with a bore for fuel injection pumps whose sealed seating is to be worked on it is not acceptable to tightly insert a bushing into the bore and a guide rod into the bushing, since the bore can be damaged in the process. German Published, Examined Patent Application DE-AS 10 52 262 obviously relates to the production of valve seats for internal combustion engines. This is suggested in the reference by the cylindrical recess following the valve seat, which could be a portion of a gas guiding channel. In such a case it is not necessary that the valve shaft which is subsequently inserted into the guide bore be exactly guided, instead it is mainly used for the transmission of force to the valve disk.

U.S. Pat. No. 4,147,462 discloses an arrangement for precision-grinding of the valve seats in an engine block. In this case a guide rod is firmly wedged into the valve tappet bore. The conical cutting tool for working the valve seat is guided on this guide rod but is at the same time double-mounted on gimbals with respect to the drive spindle, as is the guide rod, so that it is possible to compensate for an error in alignment of the drive spindle and the engine block. Fixing the guide rod in such a way is not possible in connection with the previously mentioned type of processing because in this case the surface of the bore would be damaged in an unacceptable manner. In addition, the play between the guide rod and the conical cutting tool would represent a further source of inaccuracies in processing the bezel.

U.S. Pat. No. 2,978,846 discloses a diamond-studded drilling tool for materials which are difficult to work, which is embodied as a stepped tool. It has a drill tip, followed by a guide portion and adjoining this an enlarged drill area, so that it is possible to drill a bore and a bezel at the same time. Precision-working of the bezel while maintaining concentricity, however, cannot take place in this way. It would also have to be performed in a further process step.

A grinding tool for precision-working of conical valve seats or sealing faces and also of fuel injection nozzles is known from German Patent Publication DE 29 12 814 C2, wherein the spindle which supports the conical grinding tool for working the sealing face is seated in a bushing (spindle sleeve) around which the actual workpiece is eccentrically rotated. This guidance results in a one-sided and only linear contact between the workpiece and the spindle sleeve. Such seating is not sufficiently exact to meet the requirements of an extremely exact concentricity between bezel and bore. Furthermore, this processing principle cannot be applied to a sealing face tapering toward the bore and formed by a bezel at the inlet of a bore.

OBJECT AND SUMMARY OF THE INVENTION

It is an object of the present invention to develop a method of the type mentioned at the outset in such a way that processing of the bezel takes place with considerably greater exactitude than has been possible up to now. This means precision, in particular in that the concentricity of the precision-ground bezel with respect to the bore is exactly assured and also that the angle of the bezel in relation to the bore is exactly maintained. It is intended at the same time for the method and the tool used in connection therewith to be as simple as possible.

This object is attained in accordance with the present invention by the provision of the following method steps:

a. the bezel is produced by means of a conical tool, whose angle is slightly greater than the nominal angle of the bezel;

b. the bore is honed;

c. the bezel is ground by means of a conical tool, whose angle is equal to the nominal angle of the bezel; in the process this second tool is guided in the honed bore by means of a pilot.

Thus the particular exactness of the concentricity of the bezel is attained in that the second conical tool used for precision-grinding the bezel is guided by means of a pilot in the bore which had already been previously honed, i.e. provided with a highly precise surface. The sequence of the work processes is therefore important: making the bezel (for example by turning), honing the bore, precision-grinding the bezel while guiding the precision-grinding tool in the already honed bore. A guide which is virtually free of play of the second conical tool for precision-grinding the bezel results from this final step.

The feature that the production of the bezel in step a. takes place by means of a conical turning tool whose angle is slightly greater than the nominal angle of the bezel has the important aspect that the production of the bezel starts at the inner edge of the bezel and proceeds outward, so that at the start of this procedure the inner edge of the bore also serves as the guide for the grinding part of the tool.

It is also possible to cut the prepared bezel not completely but only partially. A reduced bezel depth or bezel width possibly achieved by this is often desired in connection with fuel injection pump valves, because short control times can be achieved with this. A reduced depth or width of the bezel results in less material being cut away. This makes possible great rigidity of the tool, large adjustment intervals and a long service life.

Work in accordance with the present invention is so precise that it becomes possible to produce the bezel in the first method step simply by turning.

An advantageous further development of the present invention provides that the method step of precision-grinding of the bezel is performed in two steps, namely pre-grinding and finish- grinding. The surface quality of the bezel is further improved in this way.

Another advantageous further development of the present invention provides that the bore is again honed following the precision- grinding of the bezel. In this way honing of the bore also takes place in two steps, namely pre-honing and finish-honing. In this connection the first step (pre-honing) is used to prepare the bore for guiding the conical tool during precision-grinding of the bezel. Finish-honing results in a further improvement of the surface of the bore. At the same time it is possible to remove scores made by guiding the tool during precision-grinding of the bezel and also to remove burrs between the bezel and the bore.

A precision which results in radial play of only a few micrometers is considered to be a dimensionally accurate embodiment of the pilot in relation to the already honed bore.

A tool for executing this method in the method step of precision-grinding of the bezel is distinguished in that it has a shaft with a chucking pin, a conical grinding section adjoining it, whose angle is equal to the nominal angle of the bezel, and a dimensionally accurate pilot adjoining it. The feature is to be seen in that the pilot is matched by means of its accurate dimension to the honed surface of the bore produced in the previous method step.

In accordance with an advantageous further development of the tool it is brought into contact with the bezel by means of an axially acting spring. During rotating movement, the conical grinding section is pressed against the sealing surface to be worked, constituted by the bezel, by a pressure spring. The depth of the bezel is determined by arrival of the front interfering edge of a component surrounding the tool fixedly but adjustably on a surface of the workpiece surrounding the bore and the bezel. However, in most cases the depth of the bezel is small, since the height of the bezel of a fuel injection pump is of an order of magnitude of some one-hundredth or at most tenth of a millimeter. With the method of the present invention it is possible to achieve sealing of the valve already with a height of the bezel of, for example, 0.030 mm. This has the advantage that only very short control paths are required for the sealing needle seated on the bezel and constituting the valve. Short control paths result in short control times. While it was known up to now to achieve control paths on an order of magnitude of, for example 0.40 mm, and therefore control times between 1200 μs and 10,000 μs, control times on an order of magnitude of only 400 μs result with a bezel of only 0.030 mm.

Further advantageous developments are defined in the further dependent claims.

An exemplary embodiment will be described below, making reference to the attached drawings.

DETAILED DESCRIPTION OF THE PREFERRED EMBODIMENT

The workpiece 1 to be processed has a horizontal bore 2 and a vertical bore 3. The horizontal bore 2 is a blind bore with an interior free cut. The vertical bore 3 is widened on both ends in the form of shoulders 4,4'.

Figure 1:
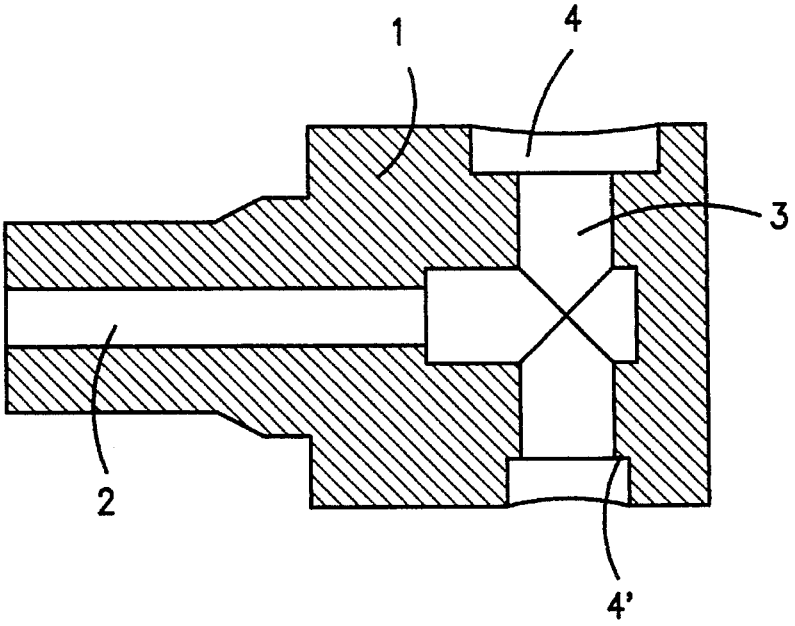
FIG. 1 is a longitudinal sectional view of a workpiece provided with a bore.
Figure 2:
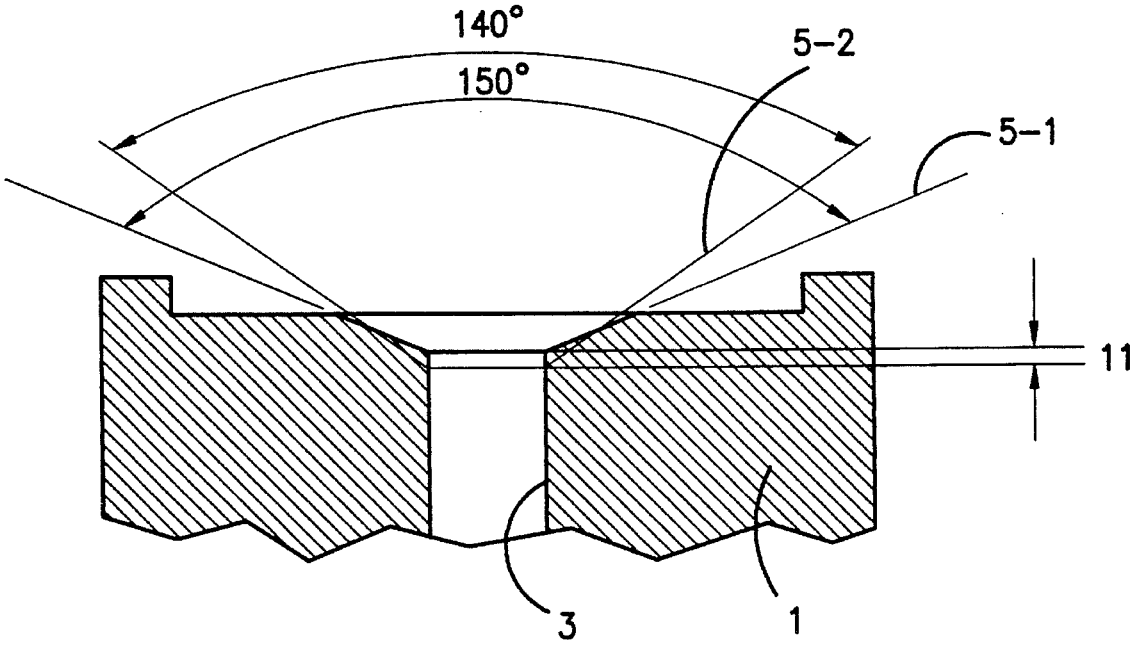
FIG. 2 shows the bore after the first method step (production of the bezel)

The bore 3 is drilled first. Then the bezel, shown in FIG. 2, is made, for example by means of a turning tool, so that it has the shape indicated by 5-1. With a nominal angle of the bezel of 140° at the end of the total process, the production by turning of the bezel having the shape 5-1 takes place in a first process step with an angle slightly exceeding the nominal angle, i.e. for example at 150°.

Following this, the bore 3 provided at its bore inlet with the bezel in the shape 5-1, is subjected to a first honing process by means of a first honing tool (not shown). This is a known production operation which therefore does not need to be further described. This honing process constitutes the method step noted above b. This results in a high degree of dimensional accuracy and a good surface of the bore 3.

This high quality of the surface of the bore 3 achieved by honing is used in the further method step c. noted above to guide the tool 6 (FIG. 4), which has a dimensionally-exact guide rod 7 for this purpose, virtually free of play and therefore extremely exact. Following the first honing process, the diameter of the guide rod 7 is guided with very little radial play, which lies in the micrometer range, i.e. virtually free of play. The tool 6 is the conical tool used in step c. As can be seen from FIG. 3 and FIG. 4, it has a chucking pin 9 at the upper end of a sleeve element 12, by means of which it is received in a rotating spindle and driven. A conical grinding section 10 adjoins the shaft 8 and the pilot 7 follows it. The cone angle of the grinding section 10 is equal to the nominal angle, i.e. the final angle of the bezel of 140°. This is the angle of the bezel in the shape 5-2 (FIG. 2). The result of this is that during precision-grinding of the bezel in this method step the grinding section 10, having an angle of 140°, meets the shape 5-1 of the bezel made during the first method step at a slightly greater angle of 150° . Thus the grinding section 10 first meets the transition between the bezel and the bore 3 and therefore produces the final shape 5-2 of the bezel from the inside toward the outside. During grinding of the bezel, grinding therefore first takes place on the inside starting along a linear contact area. With continuous processing, the contact area then becomes wider toward the outside, until finally the entire bezel has been brought into the final shape 5-2.

As already mentioned, the height 11 of the bezel in the shape 5-2 (see FIG. 2) following finishing work in step c. can be very small and in the range of 0.03 mm.

Figure 4:
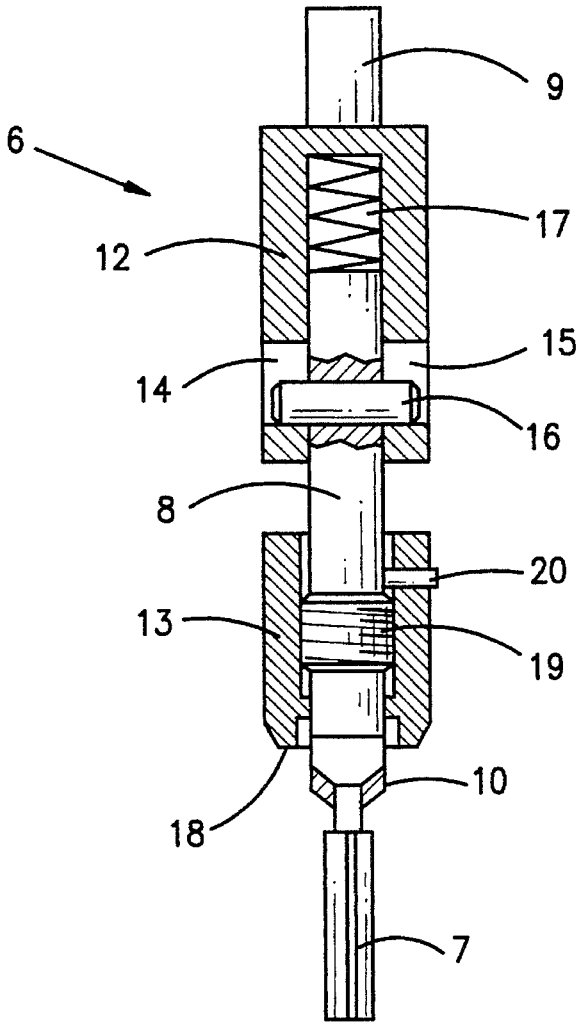
FIG. 4 shows the tool used in precision-grinding the bezel in the second method step in detail.

The shaft 8 of the tool 6 has two sleeve elements 12 and 13, which can be displaced telescope-like with respect to each other. The sleeve element 12 essentially is a cap on which the chucking pin 9 has been formed. The wall of the sleeve element 12 is provided with two elongated holes 14 and 15 extending in the axial direction and which are engaged by the ends of a transverse bolt 16. The latter is maintained fixed against relative displacement in the shaft 8 and extends vertically with respect to the long axis of the sleeve element 13. The required guidance of the two shaft elements 12 and 13 during their relative movement is obtained in this manner. A pressure spring 17 keeps the sleeve element 12 in its extended position (FIG. 4). It is compressed when the tool 6 is placed on the bezel in the shape 5-1 for processing during step c.

The second sleeve element 13 is provided with an interior thread which engages an outer thread of the section 19 of the shaft 8. In this way the position of the sleeve element 13 in relation to the shaft 8 in the longitudinal direction of the tool can be set and fixed. An adjustment screw 20 secures the set position of the sleeve element 13 to the shaft 8. An interfering edge 18 of the sleeve element 13 forms a stop on the surface of the workpiece 1 surrounding the bore 3 and in this way determines the height 11 of the finished ground bezel in the shape 5-2.

Two grinding steps can be provided for grinding the bezel in the shape 5-2. In the first step, the already cut-in bezel is pre-ground, and in the second step it is precision-ground with a tool of finer grain size.

After the bezel has been finished to shape 5-2 in the above described manner, the bore 3 can again be worked in a second honing step. If this is provided, the first honing process is pre-honing and the second honing process finish-honing. With the introduction of a honing tool into the bore 3, the burr at the transition between the bezel in the shape 5-2 and the bore 3 is also removed in the second honing process following the precision-grinding of the bezel.

Figure 3:
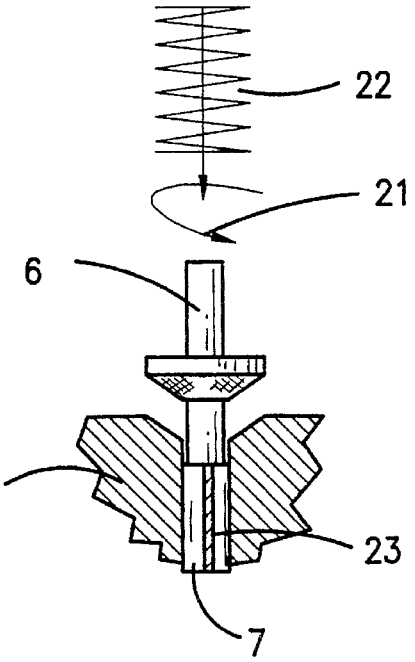
FIG. 3 shows the third method step (precision-grinding the bezel)

The tool 6 is rigidly maintained in the spindle of the processing machine. A rotary movement in the direction of the arrow 21 and a feeding movement in the direction of the arrow 22 takes place (FIG. 3). The flawless working of the bore and the bezel makes it necessary to seat the workpiece in gimbals in a known manner. It can be seen in FIG. 3 that a lubricating groove 23 is provided on the pilot of the workpiece 6.

What is claimed is:

1. A method for precision-grinding a bezel at the inlet of a bore of a workpiece to have a desired nominal angle using a first and a second grinding tool, each grinding tool having a conical grinding section with an angle slightly greater than the desired nominal angle and an angle which corresponds to the desired nominal angle, respectively, and with at least the second grinding tool having a guiding rod, comprising the steps of:

a. generating a bezel at the inlet of the bore of the workpiece by grinding the workpiece at the inlet of the bore with the first grinding tool to have a first shape defining an angle correspondingly slightly greater than the desired nominal angle;

b. honing the bore to generate a honed bore; and c. generating the desired nominal angle of the bezel by further grinding the bezel with the second grinding tool thus generating the desired nominal angle of the bezel, while simultaneously guiding the second grinding tool in the honed bore.

2. The method in accordance with claim 1, wherein the bezel in step a. is generated by turning the first grinding tool.

3. The method in accordance with claim 1, further comprising the step of: finish-honing the bezel after step c.

4. The method in accordance with claim 1, further comprising the step of:

honing the honed bore again after said grinding of the bezel with the second grinding tool to have its nominal angle.

5. The method in accordance with claim 1, wherein the bezel defines a transition into the bore, and wherein the bezel is deburred at its transition into the bore.

* * * * *